US009587428B2

(12) United States Patent
Huang

(10) Patent No.: US 9,587,428 B2
(45) Date of Patent: Mar. 7, 2017

(54) WINDOW BLIND DEVICE

(71) Applicant: TAICANG KINGFU PLASTIC MANUFACTURE CO., LTD., Taicang (TW)

(72) Inventor: Szu-Chang Huang, Changhua County (TW)

(73) Assignee: Taicang Kingfu Plastic Manufacture Co., LTD., Jiangsu Province (CN)

( * ) Notice: Subject to any disclaimer, the term of this patent is extended or adjusted under 35 U.S.C. 154(b) by 0 days.

(21) Appl. No.: 15/131,843

(22) Filed: Apr. 18, 2016

(65) Prior Publication Data

US 2016/0312528 A1 Oct. 27, 2016

(30) Foreign Application Priority Data

Apr. 23, 2015 (CN) ..... 2015 2 0248781 U
May 19, 2015 (CN) ..... 2015 2 0321138 U

(51) Int. Cl.
*E06B 9/322* (2006.01)
*E06B 9/323* (2006.01)

(52) U.S. Cl.
CPC ..... *E06B 9/322* (2013.01); *E06B 9/323* (2013.01)

(58) Field of Classification Search
CPC ... E06B 9/322; E06B 9/323; E06B 2009/3222
USPC ..... 160/170
See application file for complete search history.

(56) References Cited

U.S. PATENT DOCUMENTS

2015/0275573 A1* 10/2015 Huang ..... E06B 9/322 160/192
2016/0123447 A1* 5/2016 Chen ..... F16H 31/001 160/168.1 P
2016/0230453 A1* 8/2016 Chen ..... E06B 9/322
2016/0230454 A1* 8/2016 Chen ..... E06B 9/322
2016/0265272 A1* 9/2016 Chen ..... E06B 9/322
2016/0298385 A1* 10/2016 Chen ..... E06B 9/324
2016/0312528 A1* 10/2016 Huang ..... E06B 9/66
2016/0340975 A1* 11/2016 Huang ..... E06B 9/322

* cited by examiner

*Primary Examiner* — Blair M Johnson
(74) *Attorney, Agent, or Firm* — LeClairRyan

(57) ABSTRACT

A window blind device includes a headrail, a bottomrail, a window shade, a frame, and a plurality of control wheels. The frame includes two frame halves each including a wall body and a plurality of shaft halves. When the frame halves are brought into mating engagement with each other, male and female connecting regions of each of the shaft halves of each of the frame halves matingly fit with the female and male connecting regions of a corresponding one of the shaft halves of the other one of the frame halves, respectively.

13 Claims, 16 Drawing Sheets

WINDOW BLIND DEVICE

CROSS-REFERENCE TO RELATED APPLICATION

This application claims priorities from Chinese patent application no. 201520321138.1, filed on May 19, 2015 and Chinese patent application no. 201520248781.6, filed on Apr. 23, 2015.

FIELD

The disclosure relates to a window blind device, more particularly to a frame of a window blind device.

BACKGROUND

A conventional window blind device includes a headrail, a bottomrail, a window shade, and a sprig motor. The spring motor includes a frame and a plurality of wheel gears. The wheel gears are rotatably mounted in the frame, and are coupled to the bottomrail so as to permit the bottomrail to be displaced between uppermost and lowermost positions.

U.S. Pat. No. 6,761,203 B1 discloses a window blind, in which a frame includes a casing part and a cover part. To produce the casing part and the cover part, it is necessary to prepare two different forming molds. In addition, screws are needed for securing the cover part to the casing part.

SUMMARY

Therefore, an object of the disclosure is to provide a window blind device in which two frame halves of a frame can be easily assembled and can be made by the same forming mold.

According to the disclosure, a window blind device includes a headrail, a bottomrail, a window shade, a frame, and a plurality of control wheels. The headrail extends in a longitudinal direction. The bottomrail is disposed to be movable relative to the headrail in an upright direction between an uppermost position and a lowermost position. The window shade has an upper end connected to the headrail, and a lower end connected to the bottomrail so as to be moved therewith. The frame is disposed on the headrail, and has two frame halves which are brought into mating engagement with each other. Each of the frame halves includes a wall body having inner and outer major surfaces, a plurality of shaft halves, and at least a pair of first and second spacer halves. The shaft halves of each of the frame halves are disposed on the inner major surface of the wall body to cooperatively define a symmetrical line in the longitudinal direction, and each of the shaft halves includes a stem segment extending from the inner major surface in a direction transverse to the longitudinal direction, and a connecting segment extending from the stem segment in the transverse direction. The connecting segment has male and female connecting regions which are symmetrically arranged relative to the symmetrical line, and which are configured to matingly fit with the female and male connecting regions of a corresponding one of the shaft halves of the other one of the frame halves, respectively, such that the shaft halves of the frame halves form a plurality of supporting shafts when the frame halves are brought into mating engagement with each other. The first and second spacer halves are arranged symmetrically on the inner major surface relative to the symmetrical line, and are spaced apart from each other. The first spacer half has a first base segment disposed on the inner major surface of the wall body and a male segment disposed on the first base segment. The second spacer half has a second base segment disposed on the inner major surface of the wall body, and a female segment disposed on the second base segment. The male and female segments are configured to be brought into press fit engagement with the female and male segments of the other one of the frame halves, respectively, to form two spacers when the frame halves are brought into mating engagement with each other. The control wheels are rotatably mounted on the supporting shafts, respectively, and are coupled to the bottomrail such that the bottomrail is permitted to be displaced between the uppermost and lowermost positions.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
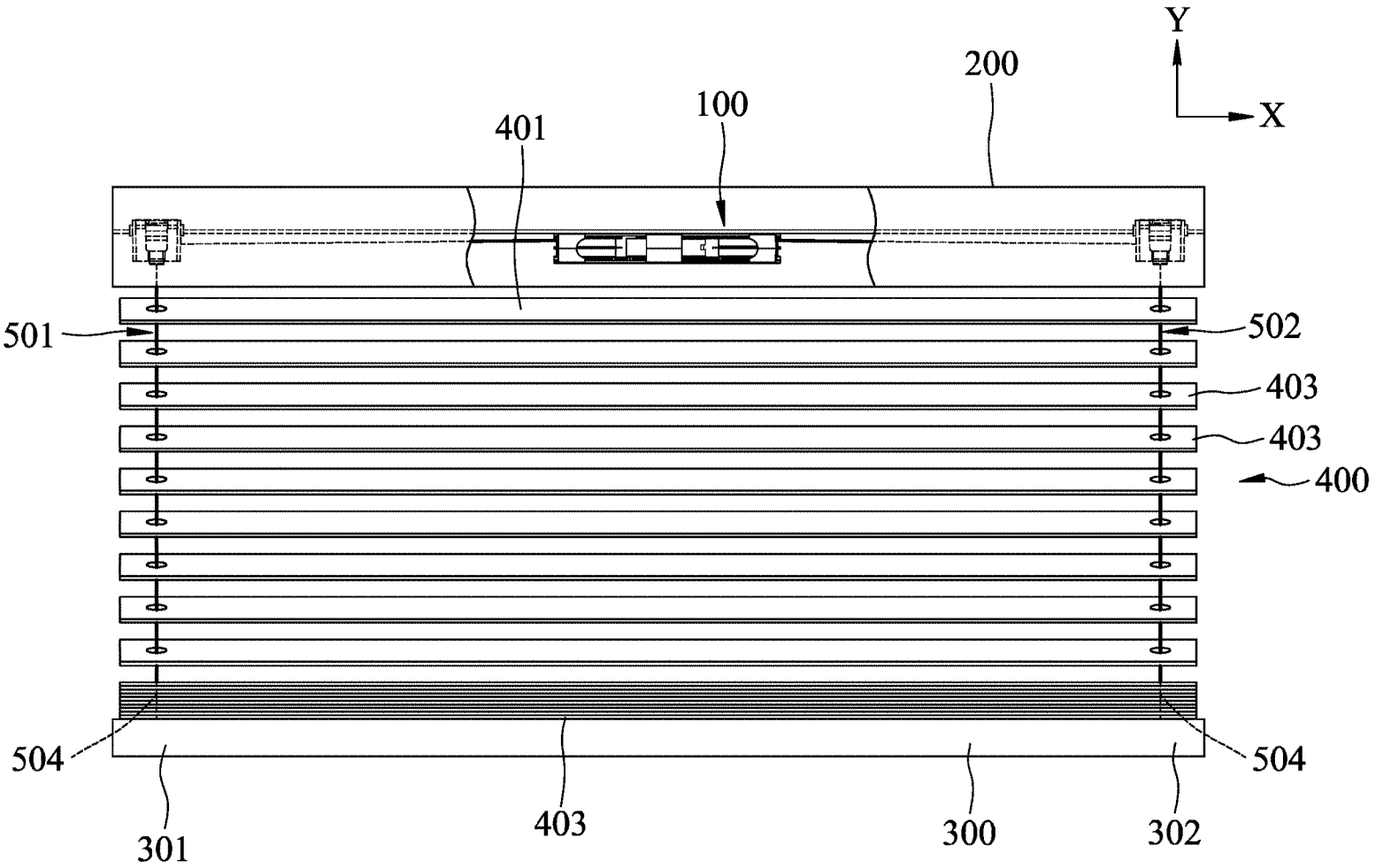
FIG. 1 is a perspective view of a window blind device according to a first embodiment of the disclosure.

Before the disclosure is described in greater detail, it should be noted that like elements are denoted by the same reference numerals throughout the disclosure.

With reference to FIG. 1, a window blind device according to a first embodiment of this disclosure includes a spring motor 100, a headrail 200, a bottomrail 300, and a window shade 400.

The headrail 200 extends in a longitudinal direction (X). The bottomrail 300 extends in the longitudinal direction (X) to terminate at left and right ends 301, 302, and is movable relative to the headrail 200 in an upright direction (Y) between an uppermost position and a lowermost position.

The window shade 400 has an upper end 401 connected to the headrail 200, and a lower end 402 connected to the bottomrail 300 so as to be moved therewith. In this embodiment, the window shade 400 includes a plurality of parallel slats 403 suspended between the headrail 200 and the bottomrail 300 in a conventional manner with the use of ladder cords (not shown).

Figure 2:
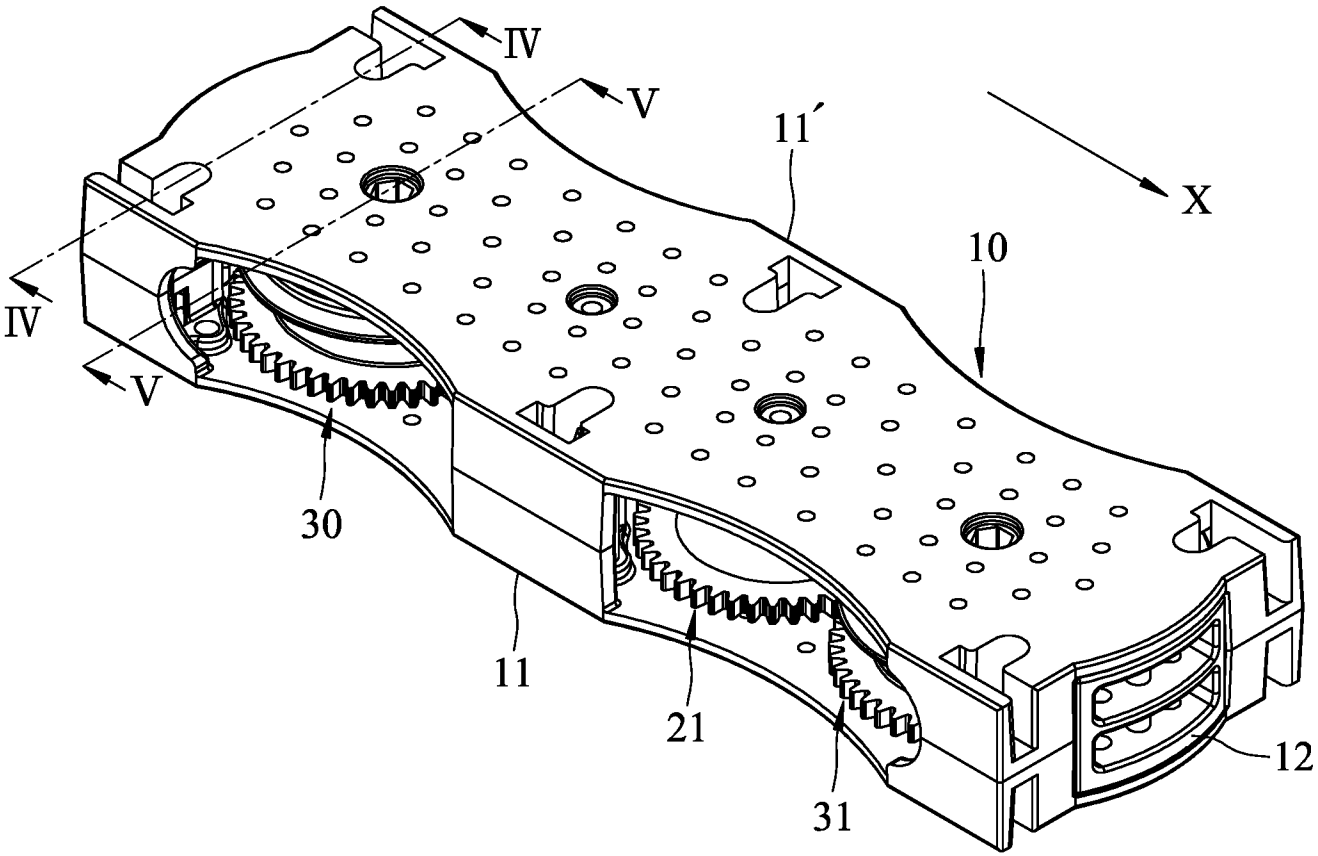
FIG. 2 is a perspective view illustrating a frame, control wheels, and cord spools of the window blind device.
Figure 3:
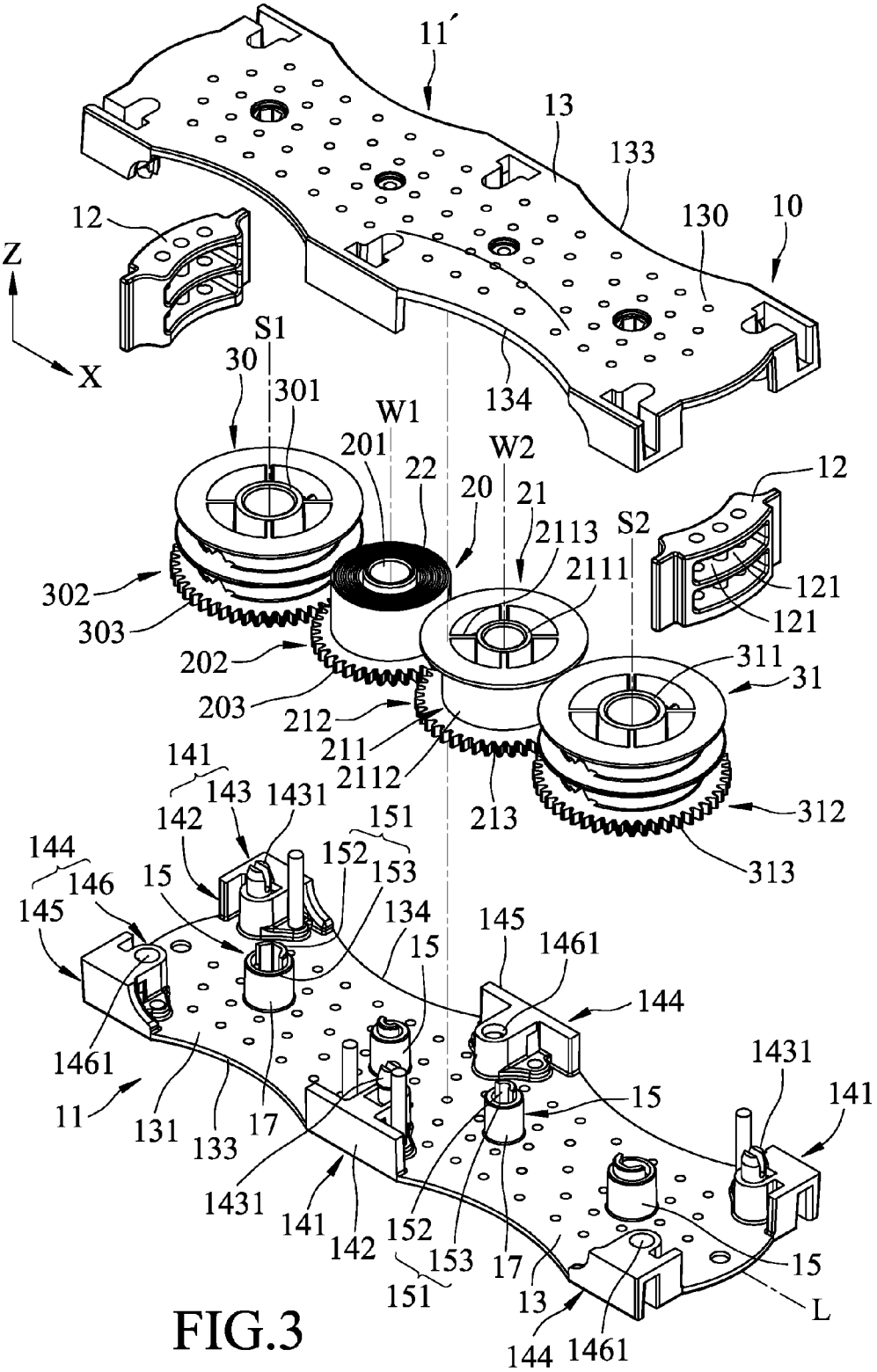
FIG. 3 is an exploded perspective view of FIG. 2.

As shown in FIGS. 1, 2 and 3, the spring motor 100 includes a frame 10, first and second control wheels 20, 21, a coil spring 22, first and second cord spools 30, 31, and first and second cords 501, 502.

Figure 4:
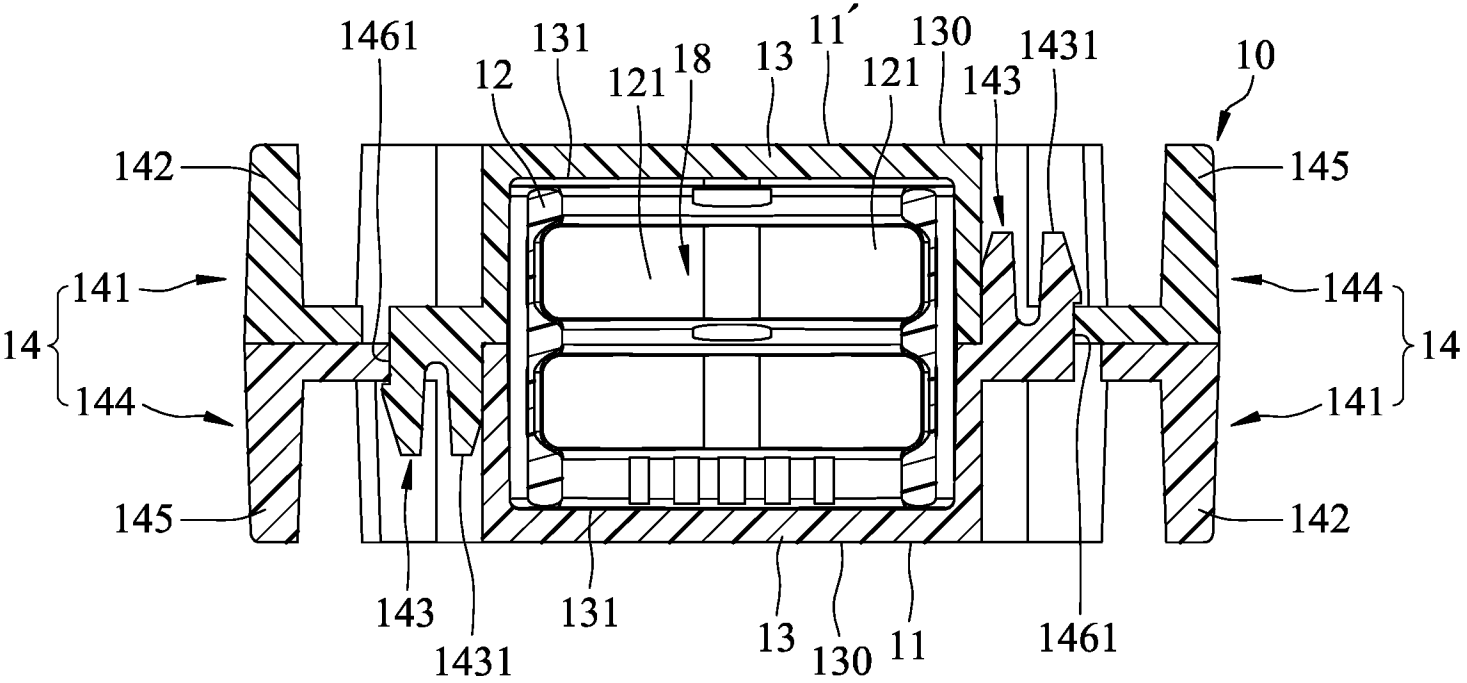
FIG. 4 is a cross-sectional view taken along line IV-IV of FIG. 2.

The frame 10 is disposed on the headrail 200, and has two frame halves 11, 11' which are brought into mating engagement with each other, and which define therebetween an accommodating space 18 (see FIG. 4). As best shown in FIG. 3, each of the frame halves 11, 11' includes a wall body 13, a plurality of shaft halves 15, and at least a pair of first and second spacer halves 141, 144.

Figure 6:
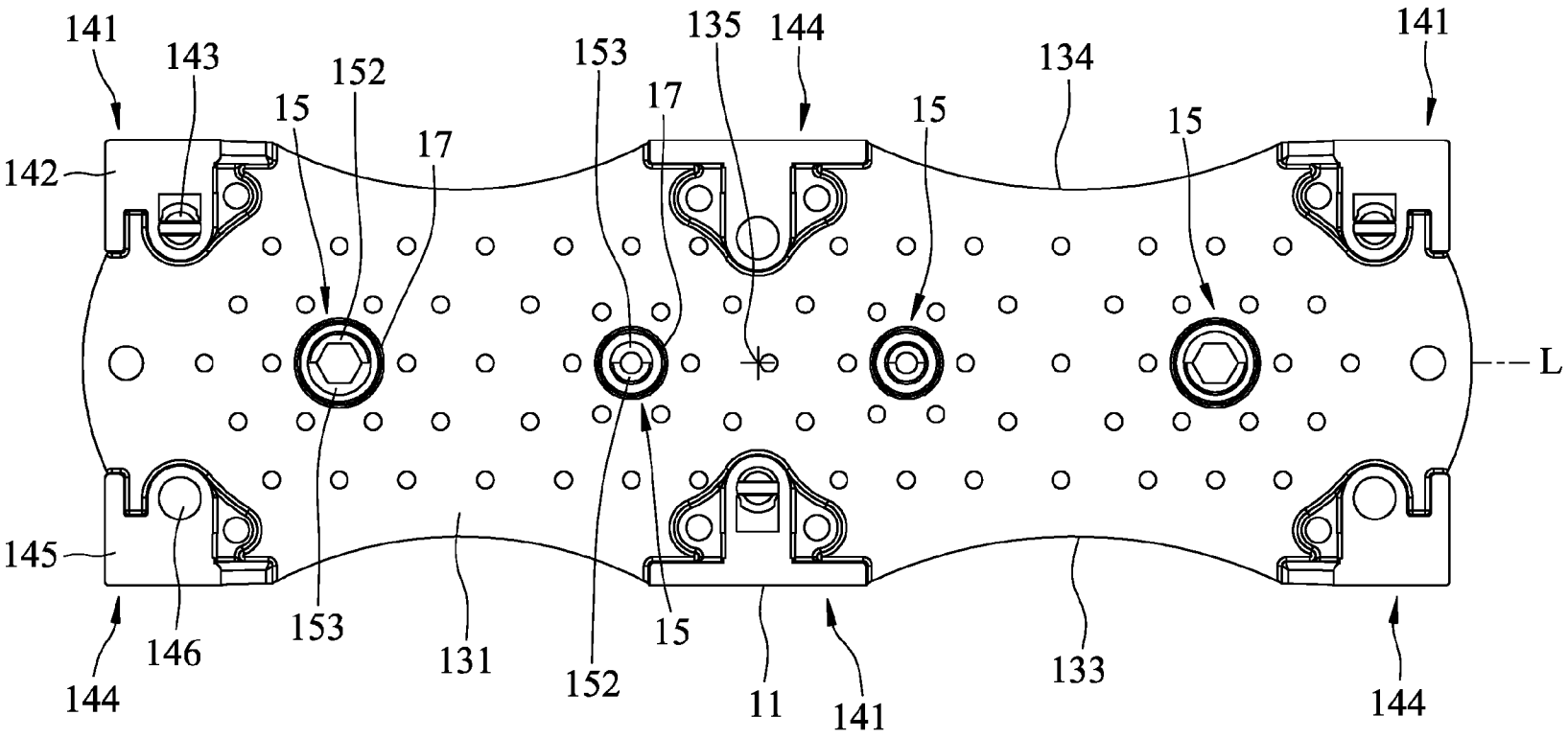
FIG. 6 is a top view of a frame half of the frame.

The wall body 13 is perforated, and has inner and outer major surfaces 131, 130, and first and second side edges 133, 134. The inner surface 131 has a geometric center 135 (see FIG. 6). The first and second side edges 133, 134 of the wall body 13 of one of the frame halves 11, 11' are respectively in alignment with the second and first side edges 134, 133 of the wall body 13 of the other one of the frame halves 11, 11' when the frame halves 11, 11' are brought into mating engagement with each other.

Figure 5:
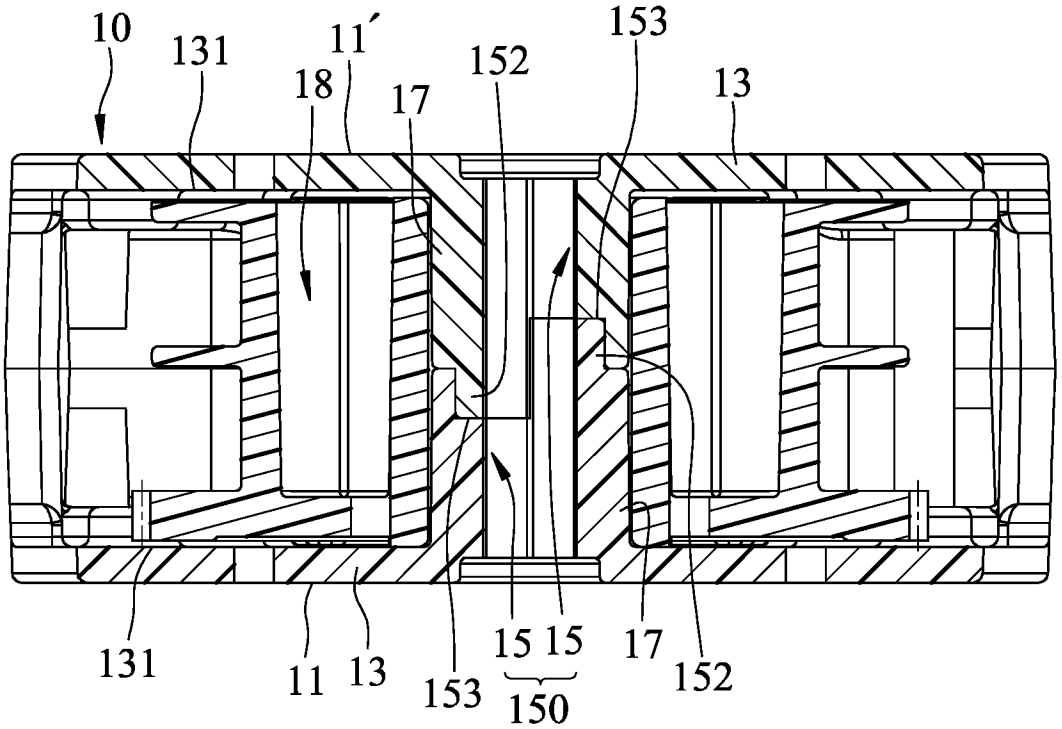
FIG. 5 is a cross-sectional view taken along line V-V of FIG. 2.

The shaft halves 15 are disposed on the inner major surface 131 of the wall body 13 of each of the frame halves 11, 11' to cooperatively define a central line (L) in the longitudinal direction (X). Each of the shaft halves 15 includes a stem segment 17 and a connecting segment 151. The stem segment 17 extends from the inner major surface 131 in a direction (Z) transverse to the longitudinal direction (X). The connecting segment 151 extends from the stem segment 17 in the transverse direction (Z), and has at least one of male and female connecting regions 152, 153. The connecting segments 151 of the shaft halves 15 are symmetrically arranged such that when said frame halves 11, 11' are brought into mating engagement with each other, the shaft halves 15 of the frame halves 11, 11' form a plurality of supporting shafts 150 (only one is shown in FIG. 5). In this embodiment, each connecting segment 151 has both the male and female connecting regions 152, 153 which are symmetrically arranged relative to the central line (L). The transverse direction (Z) is parallel to the upright direction (Y), and the geometric center 135 is on the central line (L) (see FIG. 6).

With reference to FIGS. 3 and 5 to 8, the male and female connecting regions 152, 153 of the connecting segment 151 of each of the shaft halves 15 of each of the frame halves 11, 11' are configured to matingly fit with the female and male connecting regions 153, 152 of a corresponding one of the shaft halves 15 of the other one of the frame halves 11, 11', respectively. As shown in FIG. 5, the male connecting region 152 of one of the shaft halves 15 of each of the frame halves 11, 11' and the female connecting region 153 of the corresponding one of the shaft halves 15 of the other one of the frame halves 11, 11' are of a tenon-and-mortise configuration.

With reference to FIGS. 3, 4, and 6 to 8, in each of the frame halves 11, 11', the first and second spacer halves 141, 144 are arranged symmetrically on the inner major surface 131 of the wall body 13 relative to the central line (L), and are spaced apart from each other. The first spacer half 141 has a first base segment 142 disposed on the inner major surface 131 and a male segment 143 disposed on the first base segment 142. The second spacer half 144 has a second base segment 145 disposed on the inner major surface 131, and a female segment 146 disposed on the second base segment 145. The male and female segments 143, 146 of one of the frame halves 11, 11' are configured to be brought into press fit engagement with the female and male segments 146, 143 of the other one of the frame halves 11, 11', respectively, to form two spacers 14 when the frame halves 11, 11' are brought into mating engagement with each other (see FIG. 4). The male segment 143 of each of the frame halves 11, 11' has a frustoconical plug 1431 which is bifurcated to provide resiliency to the male segment 143. The female segment 146 of each of the frame halves 11, 11' has a mating cavity 1461. The mating cavity 1461 of one of the frame halves 11, 11' is configured to be in snap fit engagement with the frustoconical plug 1431 of the other one of the frame halves 11, 11'. In this embodiment, each of the frame halves 11, 11' includes a plurality of pairs of the first and second spacer halves 141, 144.

Figure 7:
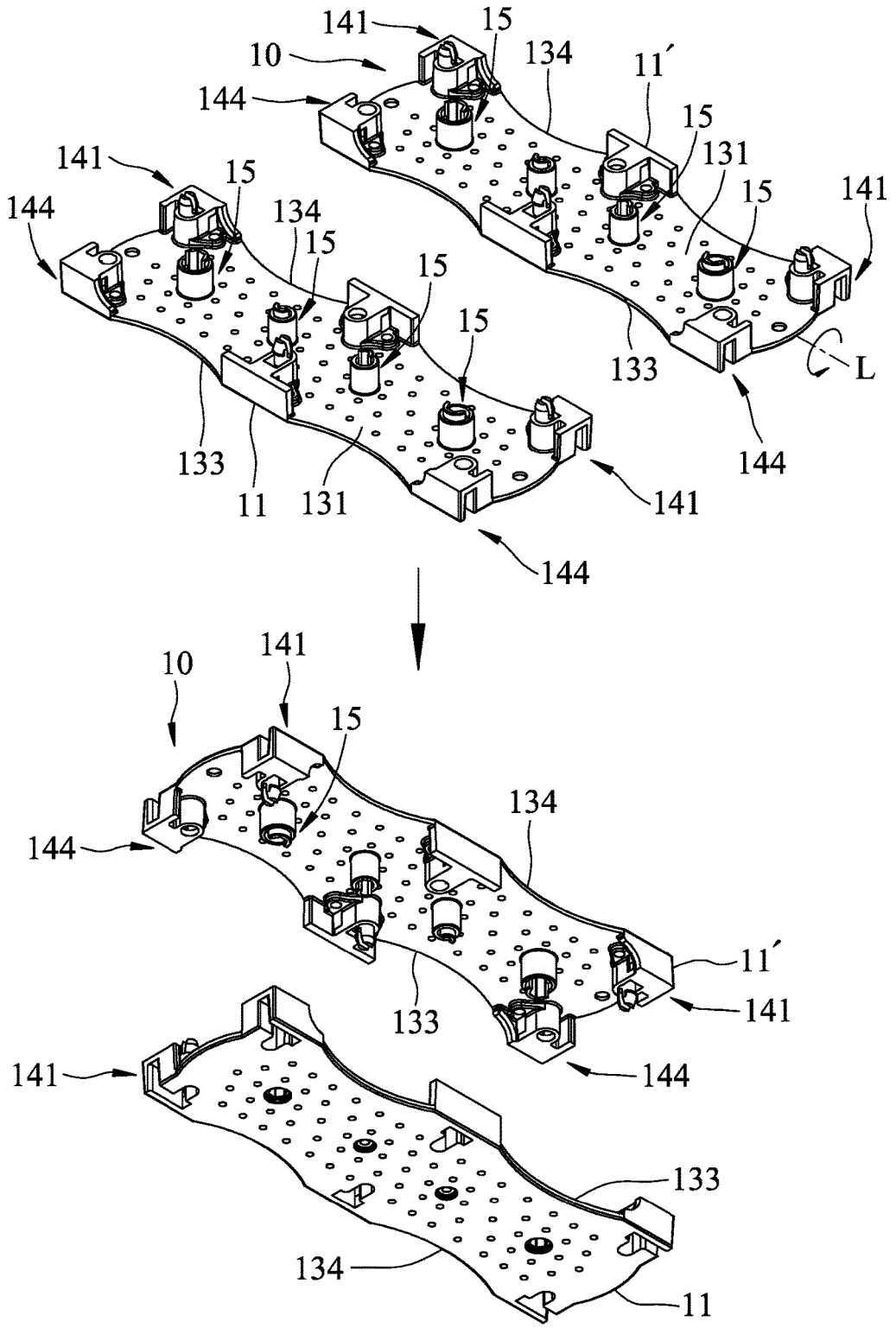
FIGS. 7 and 8 are exploded perspective views illustrating how two frame halves are assembled into a frame.
Figure 8:
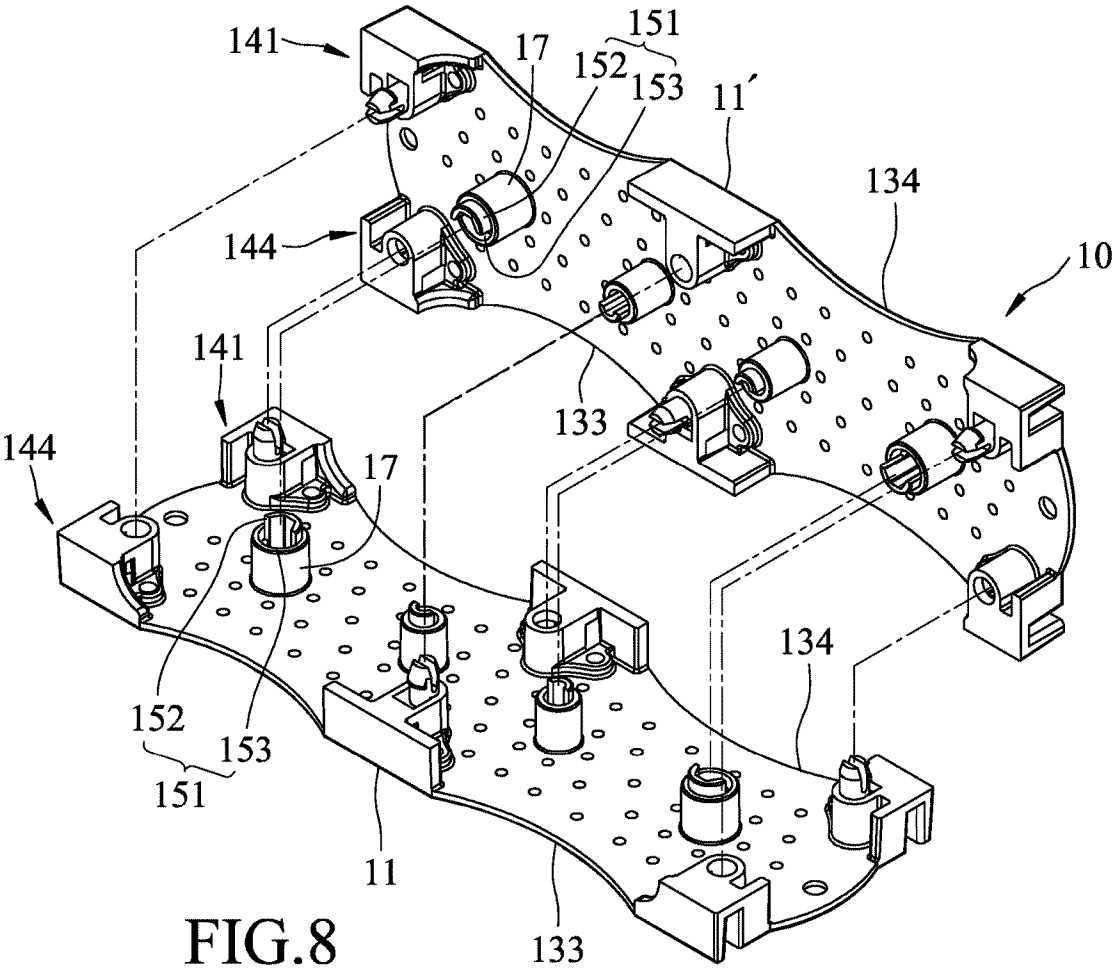

As shown in FIGS. 7 and 8, the frame halves 11, 11' are substantially the same. When assembling the frame halves 11, 11' into the frame 10, the inner major surfaces 131 of the frame halves 11, 11' are brought to face each other with the first and second side edges 133, 134 of the frame half 11 in alignment with the second and first side edges 134, 133 of the frame half 11', and the frame halves 11, 11' are then brought into mating engagement with each other.

As shown in FIGS. 2 and 3, the frame 10 further includes two side frame parts 12 which are disposed opposite to each other in the longitudinal direction (X), and which are sandwiched between the frame halves 11, 11' when the frame halves 11, 11' are brought into mating engagement with each other. Each of the side frame parts 12 has at least one through hole 121 to permit a corresponding one of the first and second cords 501, 502 to pass therethrough (see FIGS. 12 and 13). In this embodiment, each of the side frame parts 12 has a plurality of through holes 121.

Figure 10:
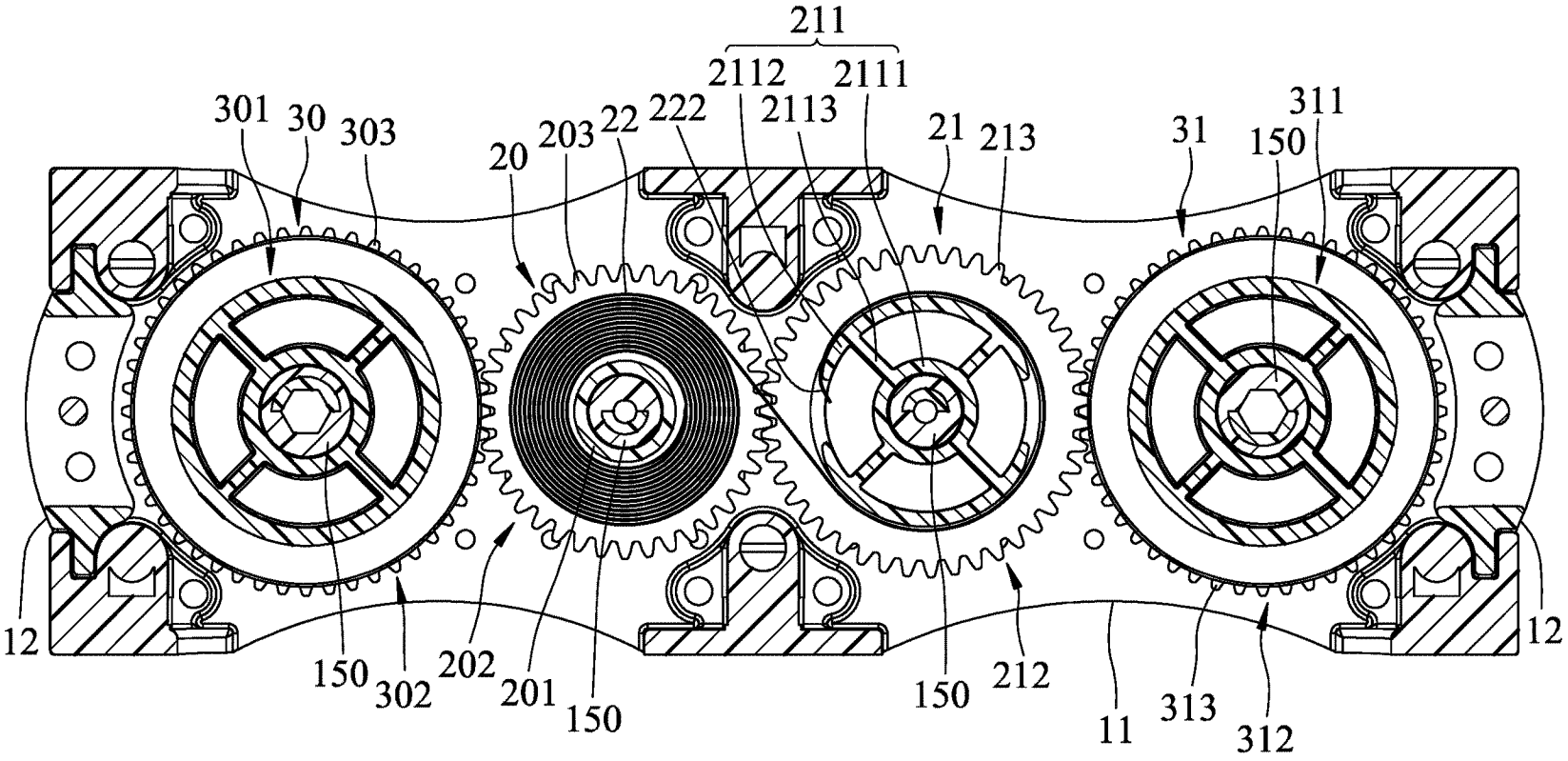
FIG. 10 is a cross-sectional view taken along line X-X of FIG. 9.

With reference to FIGS. 1 and 10, the first and second control wheels 20, 21 and the first and second cord spools 30, 31 are disposed in the accommodating space 18 to be rotatably mounted on the supporting shafts 150, respectively, and are coupled to the bottomrail 300 such that the bottomrail 300 is permitted to be displaced between the uppermost and lowermost positions.

As shown in FIGS. 3 and 10, the first control wheel 20 includes a first wheel hub 201 and a first wheel rim 202. The first wheel hub 201 is mounted rotatably on the headrail 200 by means of the frame 10 about a first wheel axis (W1). The first wheel rim 202 surrounds the first wheel axis (W1).

The second control wheel 21 includes a second wheel hub 211 and a second wheel rim 212. The second wheel hub 211 is mounted rotatably on the headrail 200 by means of the frame 10 about a second wheel axis (W2) parallel to the first wheel axis (W1). The second wheel rim 212 surrounds the second wheel axis (W2), and is configured to be in frictional engagement with the first wheel rim 202 so as to permit the first and second control wheels 20, 21 to rotate synchronously.

The first cord spool 30 includes a first spool hub 301 and a first spool rim 302. The first spool hub 301 is mounted rotatably on the headrail 200 by means of the frame 10 about a first spool axis (S1) parallel to the first wheel axis (W1). The first spool rim 302 surrounds the first spool axis (S1), and is configured to be in frictional engagement with the first wheel rim 202 so as to permit the first cord spool 30 and the first control wheel 20 to rotate synchronously.

The second cord spool 31 includes a second spool hub 311 and a second spool rim 312. The second spool hub 311 is mounted rotatably on the headrail 200 by means of the frame 10 about a second spool axis (S2) parallel to the first wheel axis (W1). The second spool rim 312 surrounds the second spool axis (S2), and is configured to be in frictional engagement with the second wheel rim 212 so as to permit the second cord spool 31 and the second control wheel 21 to rotate synchronously.

In this embodiment, the first control wheel 20 further includes a plurality of first wheel teeth 203 disposed on the first wheel rim 202 to surround the first wheel axis (W1). The second control wheel 21 further includes a plurality of second wheel teeth 213 which are disposed on the second wheel rim 212 to surround the second wheel axis (W2), and which are configured to mesh with the first wheel teeth 203 so as to permit the first and second control wheels 20, 21 to rotate synchronously. The first cord spool 30 further includes a plurality of first spool teeth 303 which are disposed on the first spool rim 302 to surround the first spool axis (S1), and which are configured to mesh with the first wheel teeth 203 so as to permit the first cord spool 30 and the first control wheel 20 to rotate synchronously. The second cord spool 31 further includes a plurality of second spool teeth 313 which are disposed on the second spool rim 312 to surround the second spool axis (S2), and which are configured to mesh with the second wheel teeth 213 so as to permit the second cord spool 31 and the second control wheel 21 to rotate synchronously.

In this embodiment, the frame 10 is made of polyoxymethylene (POM, polyacetal), and each of the first and second control wheels 20, 21 and the first and second cord spools 30, 31 is made of nylon 66 (PA 66, polyamide 6/6).

Figure 12:
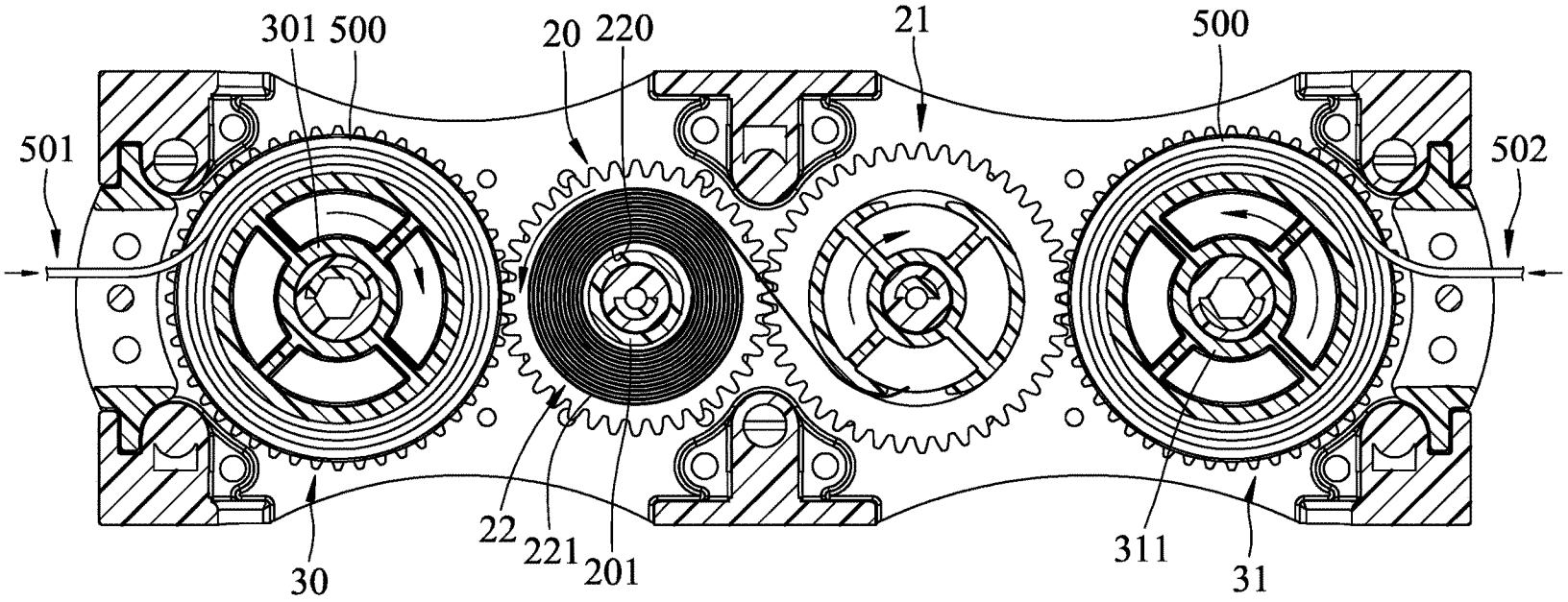
FIG. 12 is a cross-sectional view similar to FIG. 9, but illustrating a main cord segment of each of first and second cords in a drawn-in position.

With reference to FIGS. 1 and 12, each of the first and second cords 501, 502 is made of nylon 66, and has a main cord segment 500 which is wound on a corresponding one of the first and second spool hubs 301, 311, and which extends to terminate at a leading cord end 504 connected to a corresponding one of the left and right ends 301, 302 of the bottomrail 300 such that, in synchrony with the displacement of the bottomrail 300 from the uppermost position to the lowermost position, the main cord segment 500 is moved from a drawn-in position (FIG. 12) to a drawn-out position (FIG. 13) to drive the first and second cord spools 30, 31 to rotate.

Because the frame 10 is made of a material different from those of the first and second control wheels 20, 21, the first and second cord spools 30, 31, and the first and second cords 501, 502, noise produced during operation of the spring motor 100 can be reduced.

Figure 9:
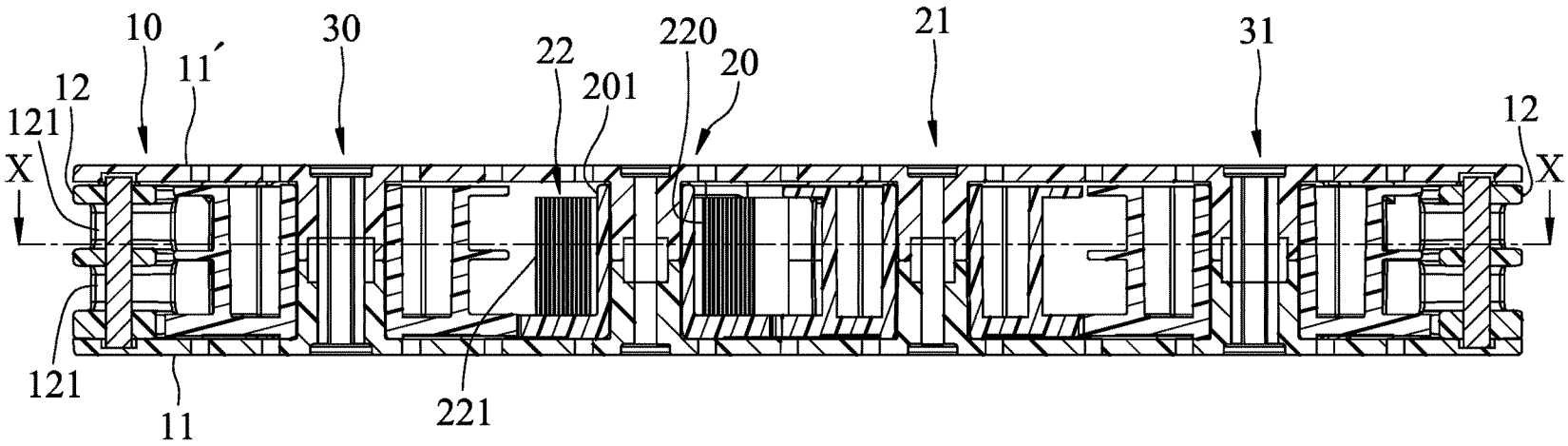
FIG. 9 is a transverse cross-sectional view of FIG. 2.
Figure 11:
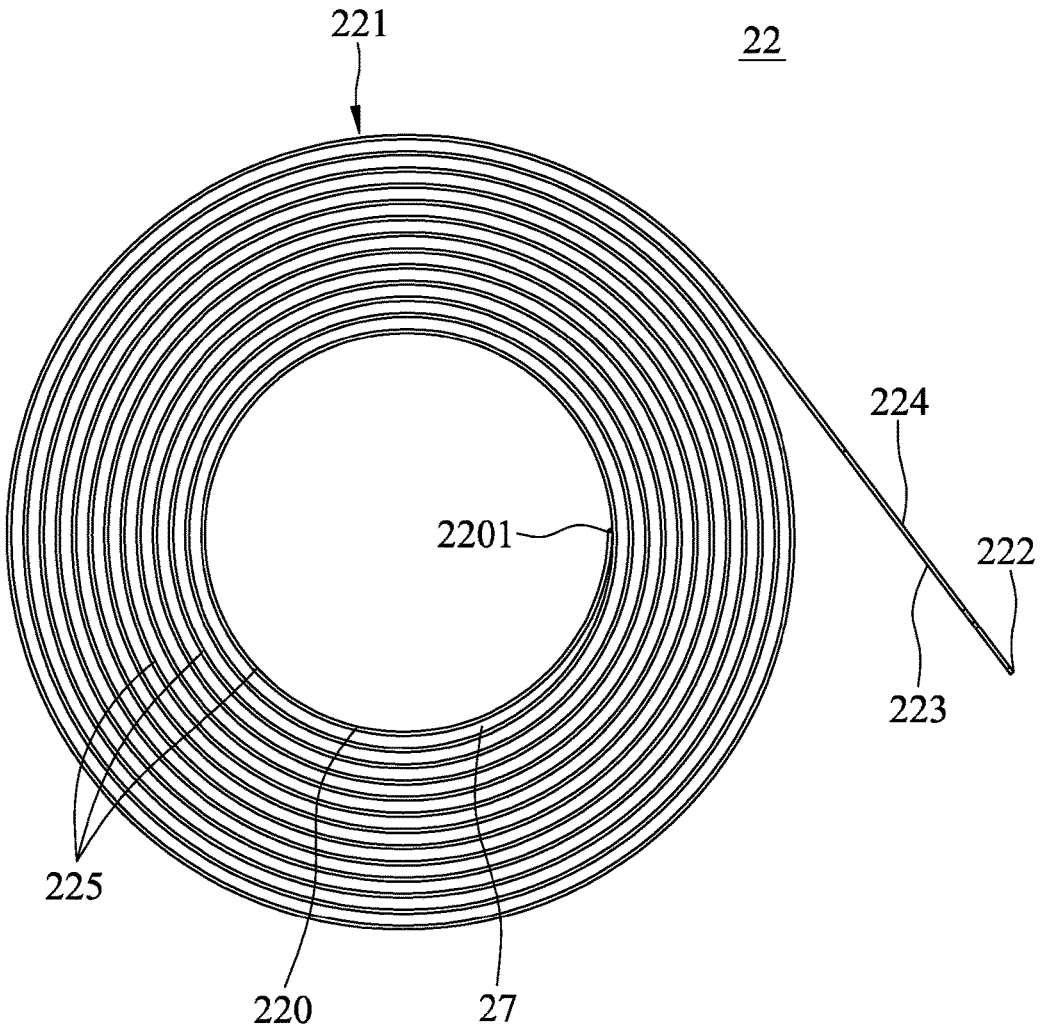
FIG. 11 is a top view of a coil spring used in the window blind device.

As shown in FIGS. 9, 10, and 11, the coil spring 22 has a looped end 220 sleeved on the first wheel hub 201, and a spring body 221 wound on the first wheel hub 201 and extending from the looped end 220 to terminate at a leading spring end 222 which is connected to the second wheel hub 211. In this embodiment, the coil spring 22 is a flat coil spring made of metal, and includes a plurality of coils 225, and the looped end 220 is formed by welding a terminal region 2201 of the spring body 221 (which is opposite to the leading spring end 222) onto the innermost coil 225. The looped end 220 is spaced apart from the spring body 221 by a non-equidistant spacing 27. The coil spring 22 has inner and outer coil surfaces 223, 224 opposite to each other. When the coil spring 22 is wound on the first wheel hub 201, the inner coil surface 223 faces the first wheel hub 201.

The second wheel hub 211 is configured to be of a larger dimension than the first wheel hub 201 such that, in response to the movement of the main cord segment 500 from the drawn-in position (FIG. 12) toward the drawn-out position (FIG. 13), the looped end 220 is rotated relative to the first wheel hub 201 to permit winding of the spring body 221 on the second wheel hub 211 to allow the spring body 221 to acquire a biasing force so as to cause the spring body 221 to wind back on the first wheel hub 201, thereby displacing the main cord segment 500 to the drawn-in position. When the spring body 221 is wound on the second wheel hub 211, the outer coil surface 224 faces the second wheel hub 221. As shown in FIG. 10, the second wheel hub 211 has an inner sub-hub 2111 of a dimension substantially the same as the first wheel hub 201, an outer sub-hub 2112 spaced apart from the inner sub-hub 2111 in radial directions, and a plurality of ribs 2113 interconnecting the inner sub-hub 2111 and the outer sub-hub 2112.

In this embodiment, because the frame halves 11, 11' are made using the same forming mold, and because they can be securely assembled without using fasteners (such as screws), the frame 10 can be produced at reduced cost. In addition, when the frame halves 11, 11' are brought into mating engagement with each other, the first and second control wheels 20, 21 and the first and second cord spools 30, 31 are supported between the frame halves 11, 11'. Thus, the spring motor 100 of the window blind device can be easily assembled.

Figure 13:
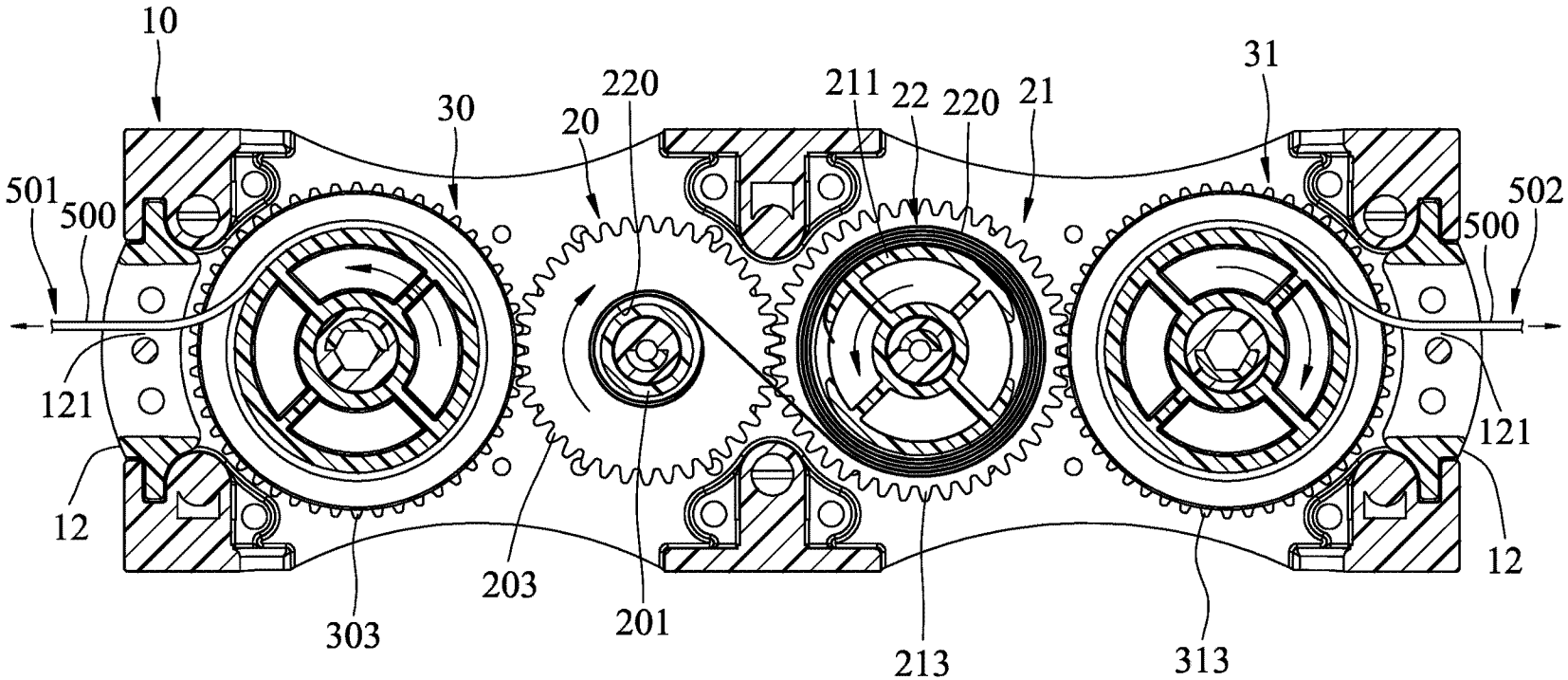
FIG. 13 is a cross-sectional view similar to FIG. 12, but illustrating the main cord segment in a drawn-out position.

When a user pulls the bottomrail 300 downwardly to displace the main cord segment 500 from the drawn-in position (FIG. 12) toward the drawn-out position (FIG. 13) and stops the bottomrail 300 at a desired position, as shown in FIG. 13, the first cord spool 30 and the second control wheel 21 rotate counterclockwise, the second cord spool 31 and the first control wheel 20 rotate clockwise, and the looped end 220 rotates relative to the first wheel hub 201 to permit the spring body 221 to be unwound from the first wheel hub 201 and to be wound on the second wheel hub 211. At this point, the spring body 221 acquires the biasing force (but the looped end 220 will not acquire a biasing force), and the bottomrail 300 is retained at the desired position by virtue of the frictional engagement among the first wheel teeth 203, the second wheel teeth 213, the first spool teeth 303, and the second wheel teeth 213. When the user pushes the bottomrail 300 upwardly, the biasing force will cause the spring body 221 to wind back on the first wheel hub 201, thereby displacing the main cord segment 500 to the drawn-in position (FIG. 12).

As the window blind of this embodiment does not include a take-up drum, and as the looped end 220 of the coil spring 22 is directly sleeved on the first wheel hub 201, the prior art drawback of wearing of the take-up drum caused by friction generated between the take-up drum and a coil spring can be avoided, and the window blind may have a longer service life.

Figure 14:
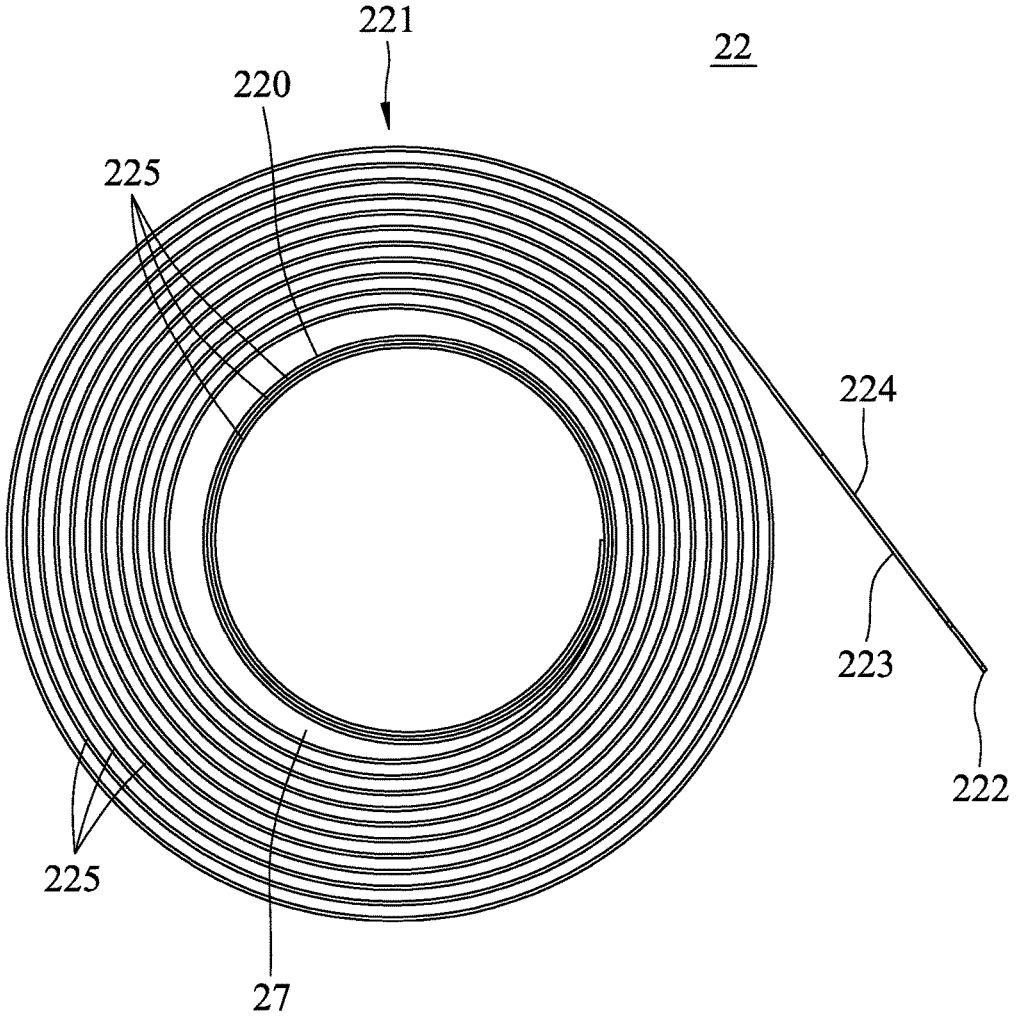
FIG. 14 is a top view of a coil spring used in a window blind device according to a second embodiment of the disclosure.
Figure 15:
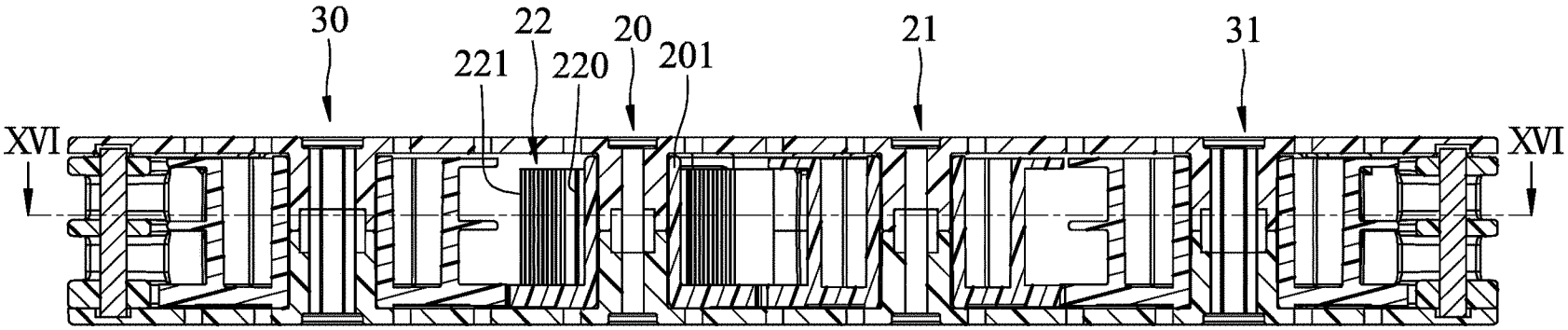
FIG. 15 is a cross-sectional view of a frame of the window blind device according to the second embodiment, in which the coil spring of FIG. 14 is sleeved on a first wheel hub.
Figure 16:
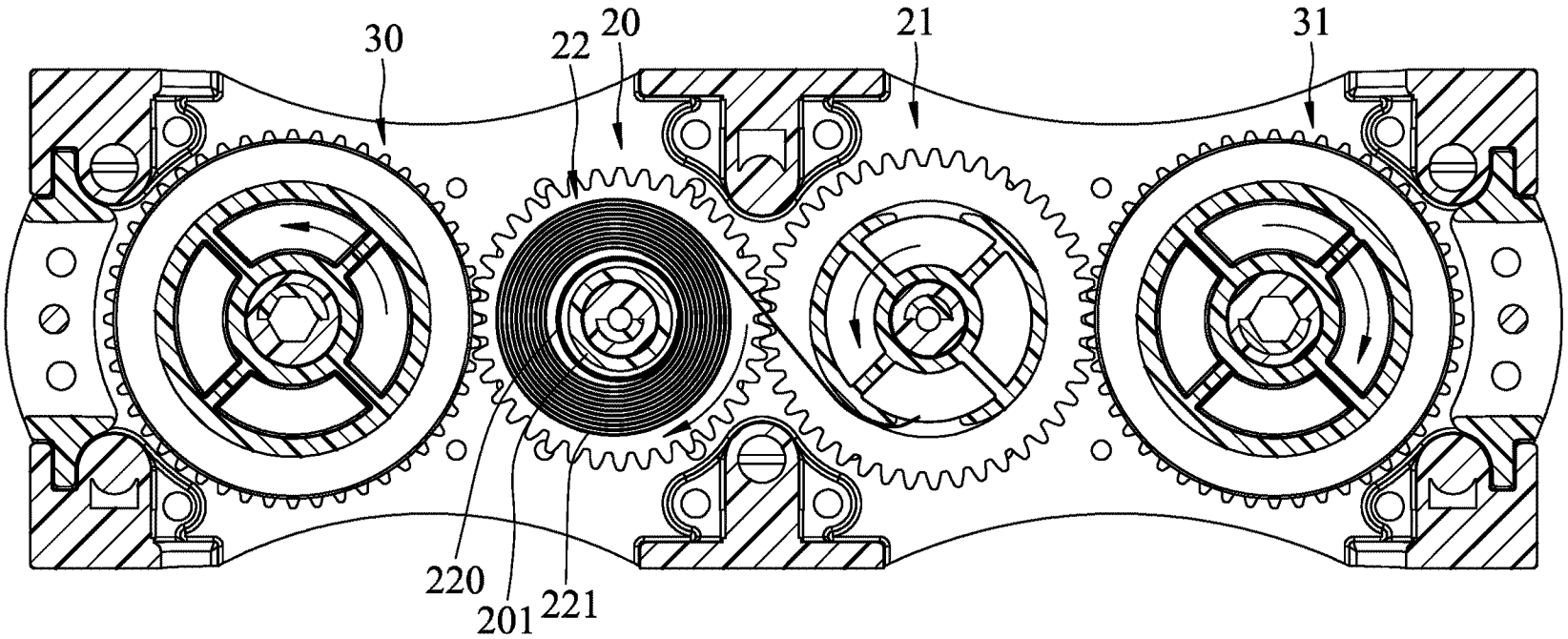
FIG. 16 is a cross-sectional view taken along line XVI-XVI of FIG. 15.

FIGS. 14 to 16 illustrate a window blind device according to a second embodiment of this disclosure. The second embodiment is similar to the first embodiment except that the looped end 220 is formed by an innermost pair of the coils 225 in abutting engagement with each other. In FIG. 14, the innermost three coils 225 are in abutting engagement with one another.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A window blind device comprising:

a headrail extending in a longitudinal direction;

a bottomrail disposed to be movable relative to said headrail in an upright direction between an uppermost position and a lowermost position;

a window shade having an upper end connected to said headrail, and a lower end connected to said bottomrail so as to be moved therewith;

a frame disposed on one of said headrail and said bottomrail, and having two frame halves which are brought into mating engagement with each other, each of said frame halves including a wall body having inner and outer major surfaces, and a plurality of shaft halves disposed on said inner major surface to cooperatively define a central line in the longitudinal direction, each of said shaft halves including a stem segment extending from said inner major surface in a direction transverse to the longitudinal direction, and a connecting segment which extends from said stem segment in the transverse direction and which has at least one of male and female connecting regions, said connecting segments of said shaft halves being symmetrically arranged such that when said frame halves are brought into mating engagement with each other, said shaft halves of said frame halves form a plurality of supporting shafts;

first and second control wheels which are rotatably mounted on two adjacent ones of said supporting shafts, respectively, and which are coupled to each other; and first and second cord spools which are rotatably mounted on two of remaining ones of said supporting shafts, respectively so as to couple said first and second control wheels to the other one of said headrail and said bottomrail such that said bottomrail is permitted to be displaced between the uppermost and lowermost positions.

2. The window blind device according to claim 1, wherein said connecting segment of each of said shaft halves on each of said frame halves has both said male and female connecting regions which are symmetrically arranged relative to the central line, and which are configured to matingly fit with said female and male connecting regions of a corresponding one of said shaft halves of the other one of said frame halves, respectively.

3. The window blind device according to claim 2, wherein each of said frame halves further includes at least a pair of first and second spacer halves which are arranged symmetrically on said inner major surface relative to the central line, and which are spaced apart from each other, said first spacer half having a first base segment disposed on said inner major surface and a male segment disposed on said first base segment, said second spacer half having a second base segment disposed on said inner major surface, and a female segment disposed on said second base segment, said male and female segments being configured to be brought into press fit engagement with said female and male segments of the other one of said frame halves, respectively, to form two spacers when said frame halves are brought into mating engagement with each other.

4. The window blind device according to claim 3, wherein said male segment of said first spacer half of each of said frame halves has a frustoconical plug, and said female segment of said second spacer half of each of said frame halves has a mating cavity configured to be in snap fit engagement with said frustoconical plug of said first spacer half of the other one of said frame halves.

5. The window blind device according to claim 4, wherein said frustoconical plug is bifurcated to provide resiliency to said male segment.

6. The window blind device according to claim 3, wherein said male connecting region of each of said shaft halves of each of said frame halves and said female connecting region of the corresponding one of said shaft halves of the other one of said frame halves are of a tenon-and-mortise configuration.

7. The window blind device according to claim 1, wherein said wall body is perforated.

8. The window blind device according to claim 1, wherein said frame is made of polyoxymethylene, and each of said first and second control wheels and said first and second cord spools is made of nylon 66.

9. The window blind device according to claim 3, wherein each of said frame halves includes a plurality of pairs of said first and second spacer halves.

10. The window blind device according to claim 8, further comprising first and second cords each of which couples one of said first and second cord spools to said the other one of said headrail and said bottomrail.

11. A spring motor for a window blind, said window blind including a headrail which extends in a longitudinal direction, a bottomrail which is disposed to be movable relative to the headrail in an upright direction between an uppermost position and a lowermost position, and a window shade which has an upper end connected to the headrail and a lower end connected to the bottomrail so as to be moved therewith, said spring motor comprising:

a frame disposed on one of said headrail and said bottomrail, and having two frame halves which are brought into mating engagement with each other, each of the frame halves including a wall body having inner and outer major surfaces, and a plurality of shaft halves disposed on said inner major surface to cooperatively define a central line in the longitudinal direction, each of said shaft halves including a stem segment extending from said inner major surface in a direction transverse to the longitudinal direction, and a connecting segment which extends from said stem segment in the transverse direction and which has at least one of male and female connecting regions, said connecting segments of said shaft halves being symmetrically arranged such that when said frame halves are brought into mating engagement with each other, said shaft halves of said frame halves form a plurality of supporting shafts;

first and second control wheels which are rotatably mounted on two adjacent ones of said supporting shafts, respectively, and which are coupled to each other;

first and second cord spools which are rotatably mounted on two of remaining ones of said supporting shafts, respectively, and which are coupled to said first and second control wheels, respectively; and first and second cords each of which couples one of said first and second cord spools to the other one of said headrail and said bottomrail such that the bottomrail is permitted to be displaced between the uppermost and lowermost positions.

12. The spring motor according to claim 11, wherein said frame is made of polyoxymethylene, and each of said first and second control wheels and said first and second cord spools is made of nylon 66.

13. The spring motor according to claim 11, wherein said wall body is perforated.

* * * * *